US008926061B2

(12) United States Patent
Bansyo et al.

(10) Patent No.: US 8,926,061 B2
(45) Date of Patent: Jan. 6, 2015

(54) INKJET PRINTER AND INKJET HEAD MAINTENANCE METHOD

(75) Inventors: Toshihiro Bansyo, Ibaraki-ken (JP); Asayo Nishimura, Ibaraki-ken (JP); Hiroshi Sugitani, Ibaraki-ken (JP)

(73) Assignee: Riso Kagaku Corporation, Tokyo (JP)

( * ) Notice: Subject to any disclaimer, the term of this patent is extended or adjusted under 35 U.S.C. 154(b) by 202 days.

(21) Appl. No.: 13/188,017

(22) Filed: Jul. 21, 2011

(65) Prior Publication Data

US 2012/0019590 A1 Jan. 26, 2012

(30) Foreign Application Priority Data

Jul. 26, 2010 (JP) ..... P2010-166921

(51) Int. Cl.

| | |
|---|---|
| ***B41J 2/165*** | (2006.01) |
| ***B41J 2/175*** | (2006.01) |
| ***B41J 29/38*** | (2006.01) |
| *B41J 2/18* | (2006.01) |

(52) U.S. Cl.

CPC ..... *B41J 2/16523* (2013.01); *B41J 2/16585* (2013.01); *B41J 2/175* (2013.01); *B41J 29/38* (2013.01); *B41J 2/18* (2013.01)

USPC ..... 347/35

(58) Field of Classification Search

None

See application file for complete search history.

(56) References Cited

U.S. PATENT DOCUMENTS

2008/0218554 A1* 9/2008 Inoue ..... 347/33

FOREIGN PATENT DOCUMENTS

| | | |
|---|---|---|
| JP | 2000-355108 | 12/2000 |
| JP | 2004-106304 A | 4/2004 |
| JP | 2008-221534 | 9/2008 |

OTHER PUBLICATIONS

Official Action issued in Japanese Patent Application No. 2010-166921 dated Dec. 10, 2013, 2 pages.

* cited by examiner

*Primary Examiner* — Alejandro Valencia

(74) *Attorney, Agent, or Firm* — Nath, Goldberg & Meyer; Jerald L. Meyer

(57) ABSTRACT

An inkjet printer 1 includes an inkjet head 31 with nozzles for discharging ink, a pressurizer for pressurizing a route for ink supply to the inkjet head 31, a head driver 6 for driving the inkjet head 31, and a controller 8 operable for control the pressurizer to pressurize the route for a prescribed time to have fluxes of ink once spilt out of the nozzles and to render nozzles covered with spilt ink before use of the head driver 6 to drive the inkjet head 31 for discharge operation in a maintenance service to the inkjet head 31.

8 Claims, 13 Drawing Sheets

INKJET PRINTER AND INKJET HEAD MAINTENANCE METHOD

BACKGROUND OF THE INVENTION

1. Field of the Invention

The present invention relates to an inkjet printer adapted to discharge ink through nozzles at an inkjet head to make a record on a recording medium, and a maintenance method of inkjet head.

2. Description of Related Art

Inkjet printers sometimes suffer from precipitates attached to nozzles in a set of inkjet heads due to developments of ink solvent evaporation such as while running or in a waiting mode. Such attached matter tends to cause discharge troubles such as failed discharge or disordered ink discharge directions at nozzles, resulting in a debased record quality.

There are inkjet printers employing maintenance operations as solutions to eliminate discharge troubles due to such attached matter. As a known maintenance operation, there is a flushing operation to be performed between printing services by discharging unused ink after printing to remove attached matter and so on from nozzles. As another known maintenance operation, there is a purge operation making use of an ink supply line as a route to an inkjet head in a pressurized state for pressing ink to spill out of nozzles, while using wipers to remove spilt ink together with dusts adhering on the face of nozzle header.

Flushing operations afford to apply higher pressures to individual nozzles than purge operations with higher efficiencies to remove attached matter from nozzles. Such flushing operations need an implement for receiving discharged ink and ink mist attending the discharge. To this point, there are known printers provided with a tray-shaped ink receiving member to be set in flushing operation in a position under inkjet heads to receive ink, ink mist, and others.

However, in some cases, even if such an ink receiving member is provided under inkjet heads, there is an open space lying between the ink receiving member and inkjet heads, thereby leaving discharged ink particles and ink mist as they are free to float and causing contamination in the printer. In particular, when flushed under a condition having foreign matters or viscosity-increased ink residing in nozzles, there occur disordered discharge states including fine mist-like ink droplets propelled outside or fluxes of ink discharged failing to go in normal downward directions. There is an attending anxiety about increased ink mist floating in the printer, thereby causing worse contamination in the printer. Even in cases raising nozzle pressures for enhancing performance in discharge restoration, there likewise occur disordered ink-discharging states with increased tendencies, thereby having worse contamination in the printer.

There are techniques proposed in Japanese Patent Application laid-open Publication No. 2004-106304, including a flushing operation using caps for covering nozzle header faces of inkjet heads, while operating a suction pump for collecting discharged fluxes of ink and ink mist in the caps. This arrangement is effective to suppress contamination due to discharged ink particles or ink mist in the printer.

SUMMARY OF THE INVENTION

However, as described above, to implement a collection by suction of discharged fluxes of ink and ink mist in flushing operations there is a need to provide caps adapted to closely contact and tightly sealing inkjet heads with an arrangement including a suction pump for sucking fluxes of ink, ink mist, etc., and a system of suction routes. Such configuration is likely to invite increased complexity in arrangement and enlargement in size of the printer.

The present invention has been devised in view of such issues. It therefore is an object of the present invention to provide an inkjet printer and an inkjet head maintenance method that can suppress contamination in the printer in a maintenance operation with avoiding increased complexity of arrangement in the printer and enlargement in size of the printer.

To achieve the object described, according to an aspect of the present invention, there is an inkjet printer comprising an inkjet head configured with nozzles for ink discharge, a pressurizer configured to pressurize a route for ink supply to the inkjet head, a head driver configured to drive the inkjet head, and a controller configured to control the pressurizer to pressurize the route for a prescribed time to have fluxes of ink once spilt out of the nozzles and to render a nozzle covered with a spill of ink before use of the head driver to drive the inkjet head for discharge operation in a maintenance service to the inkjet head.

Further, according to another aspect of the present invention, there is an inkjet head maintenance method for an inkjet head in an inkjet printer including the inkjet head being configured with nozzles for ink discharge, a pressurizer configured to pressurize a route for ink supply to the inkjet head, and a head driver configured to drive the inkjet head, the inkjet head maintenance method comprising using the pressurizer to pressurize the route for a prescribed time to have fluxes of ink once spilt out of the nozzles and to render a nozzle covered with a spill of ink, and using the head driver to drive the inkjet head for discharge operation.

DETAILED DESCRIPTION OF EMBODIMENTS

Figure 1:
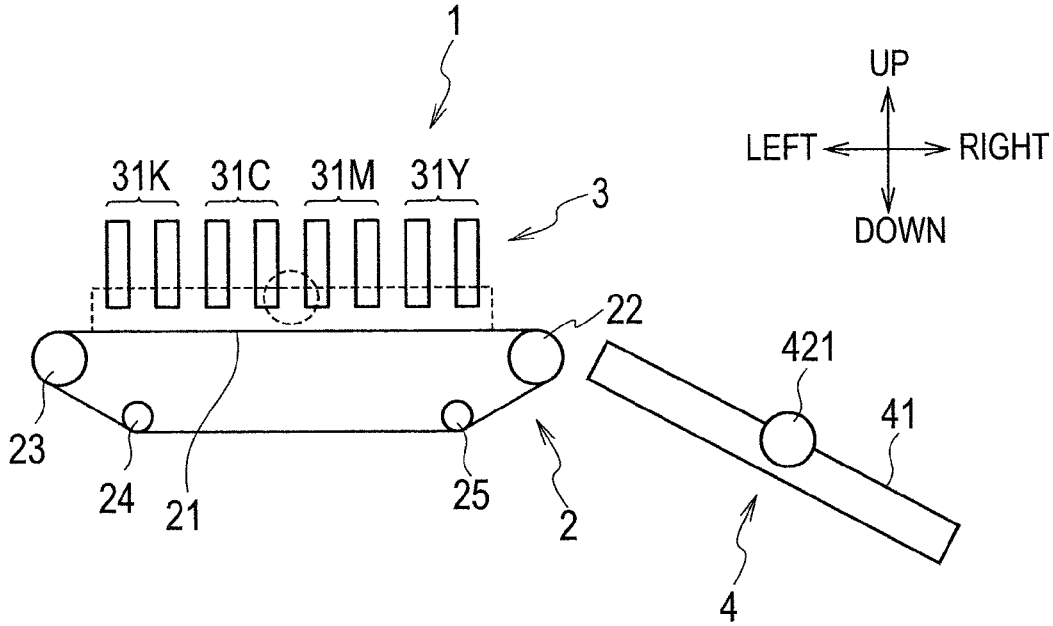
FIG. 1 is an illustration of schematic configuration of an inkjet printer according to an embodiment of the present invention.

There will be described an embodiment of the present invention with reference to the drawings. In the drawings, like or equivalent parts or constituent elements are designated by like or equivalent reference signs. It is noted that drawings show what is typical, not real. Some parts have size relationships or proportions different between drawings.

Figure 2:
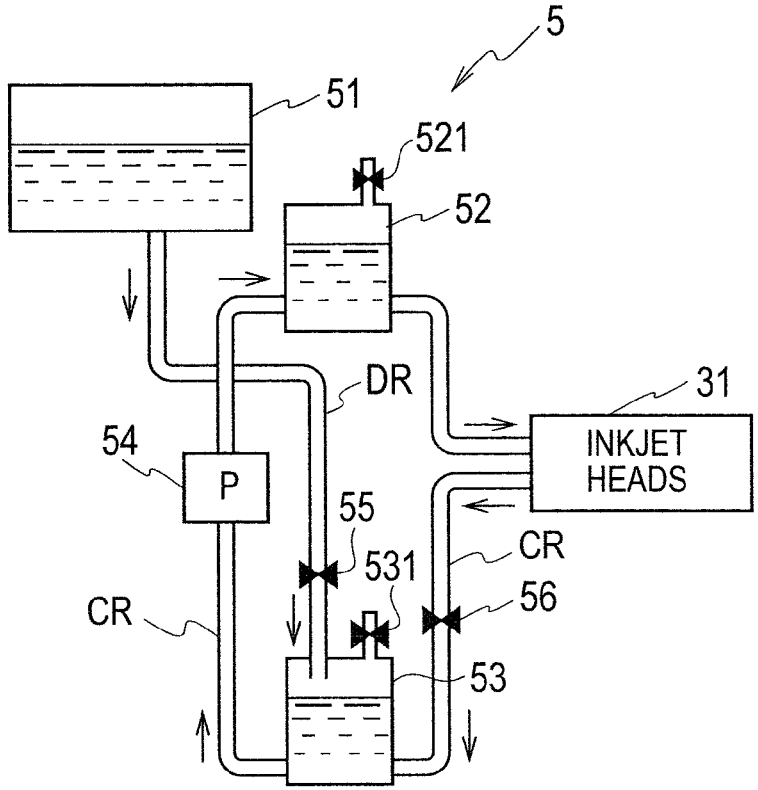
FIG. 2 is an illustration of schematic configuration of an ink circulation mechanism.
Figure 3:
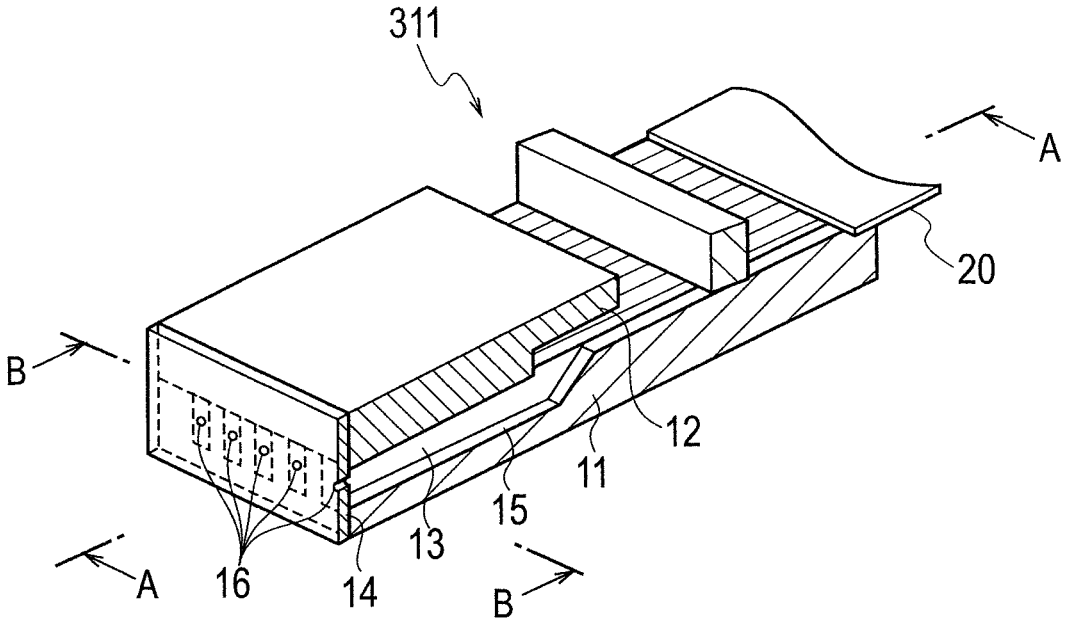
FIG. 3 is a perspective view, partly in section, of schematic configuration of a unit head constituting an inkjet head.
Figure 4:
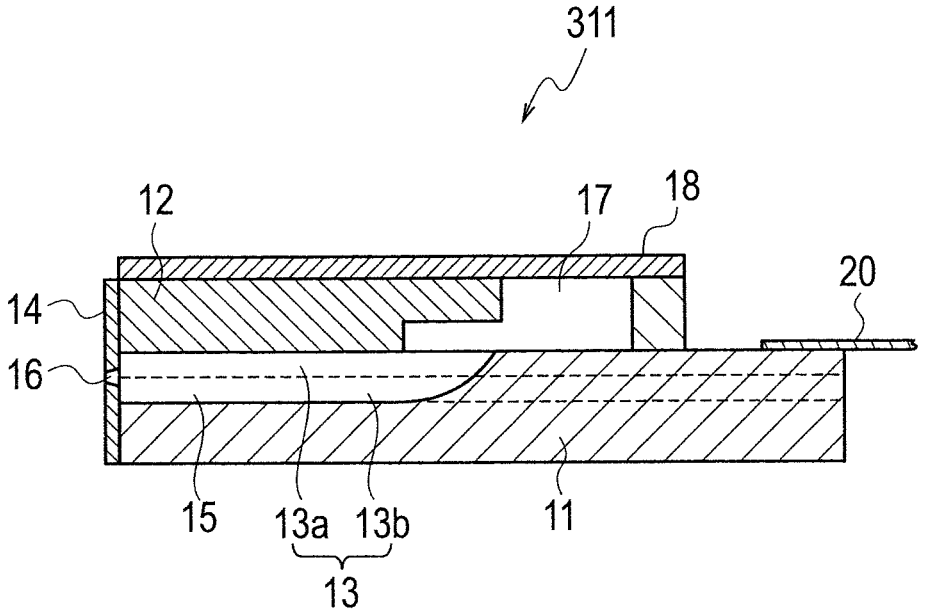
FIG. 4 is a section along line A-A of FIG. 3.
Figure 5:
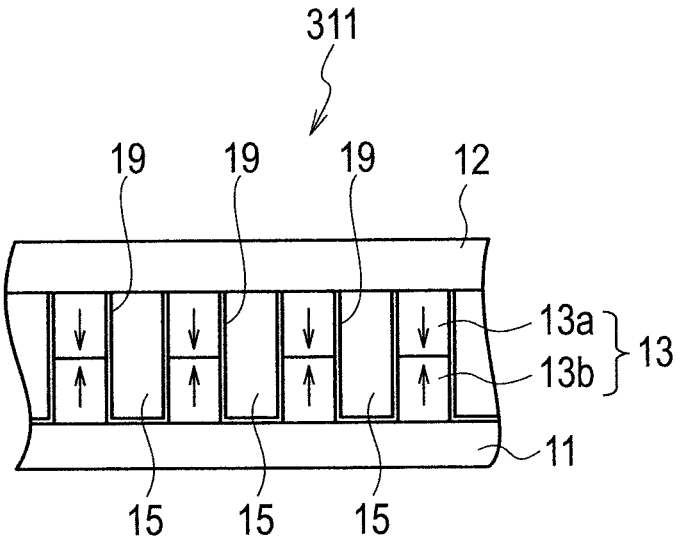
FIG. 5 is a section along line B-B of FIG. 3.
Figure 6:
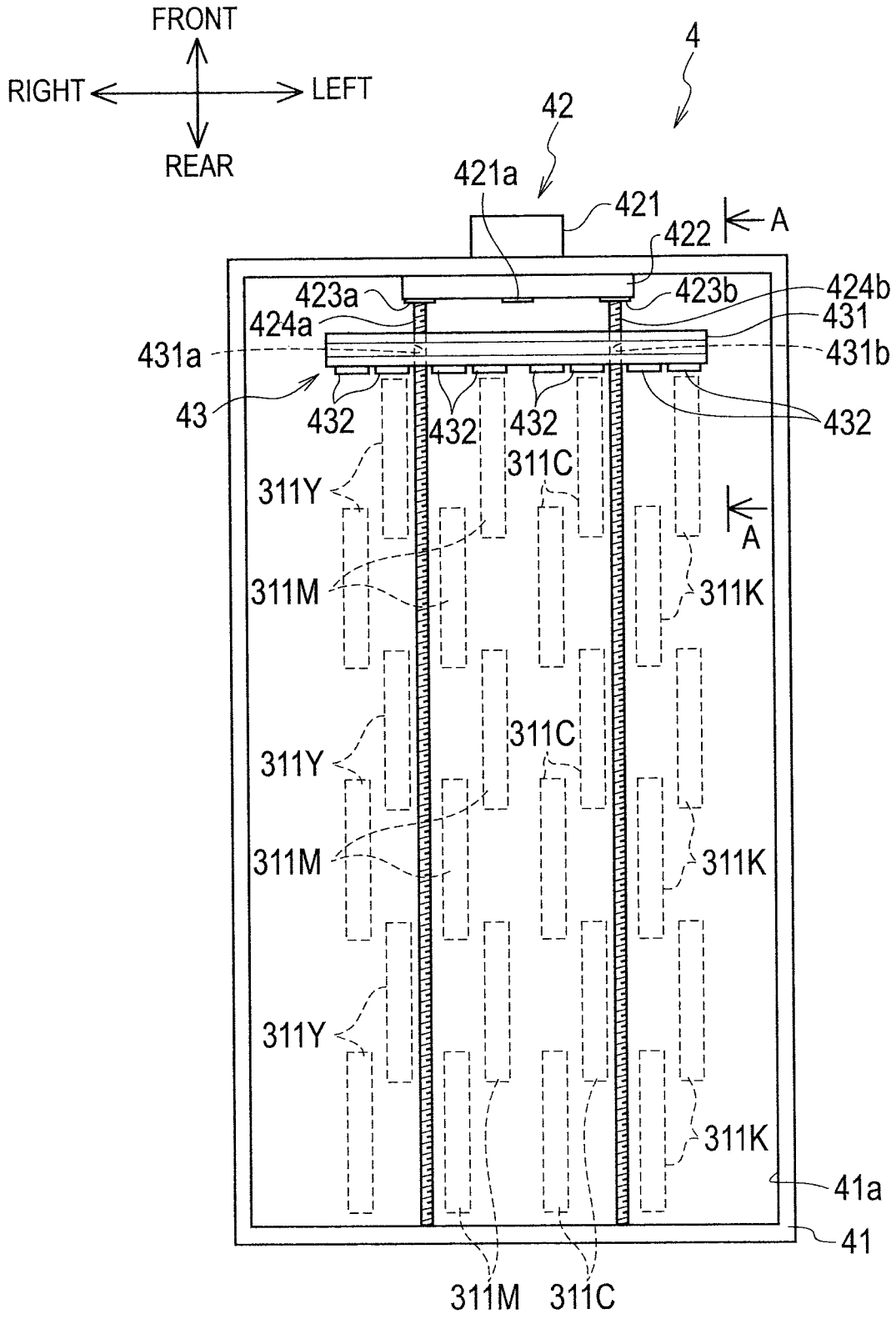
FIG. 6 is a plan view of a maintenance unit.
Figure 7:
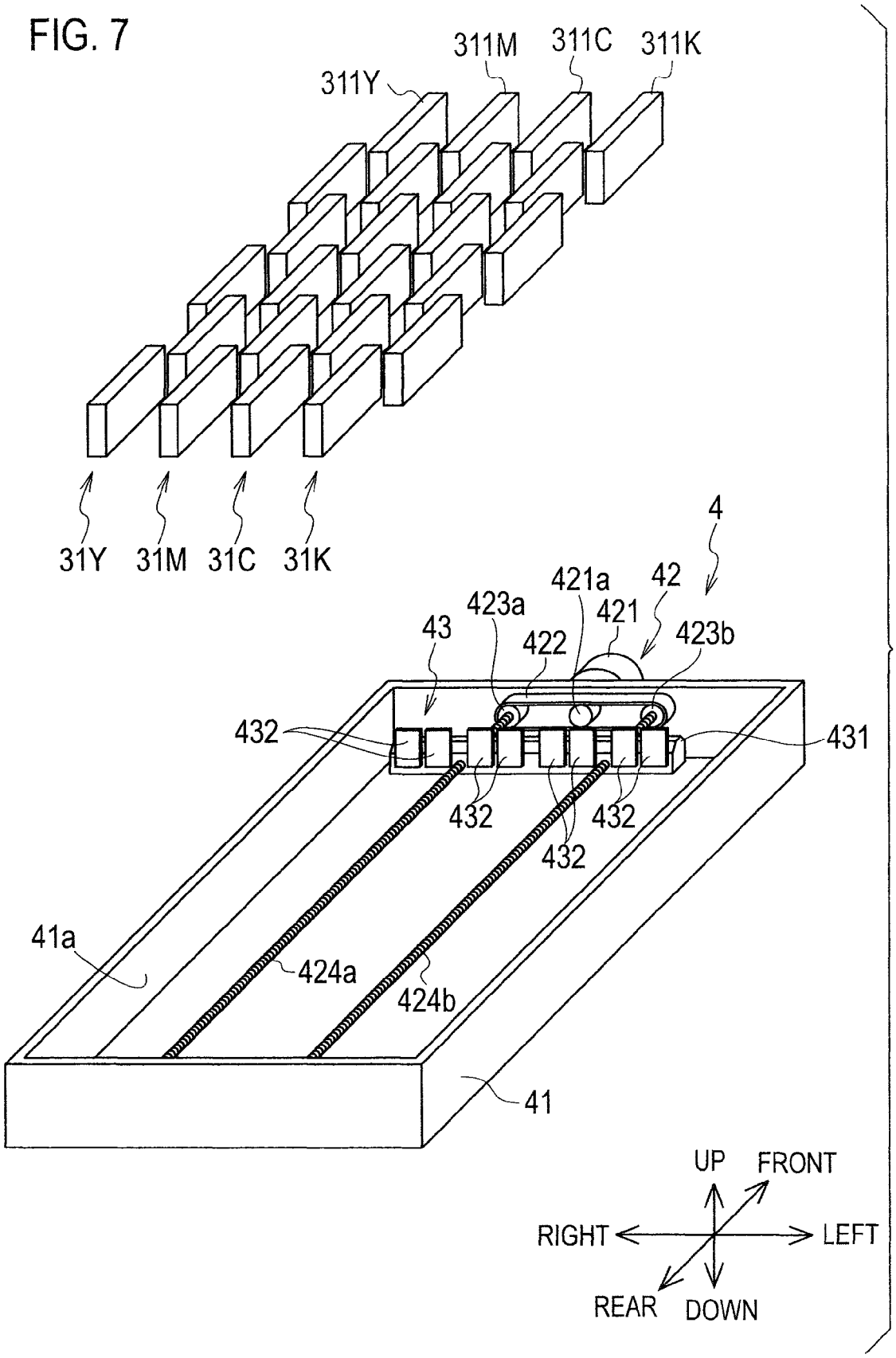
FIG. 7 is an exploded perspective view including the maintenance unit and a set of inkjet heads.
Figure 8:
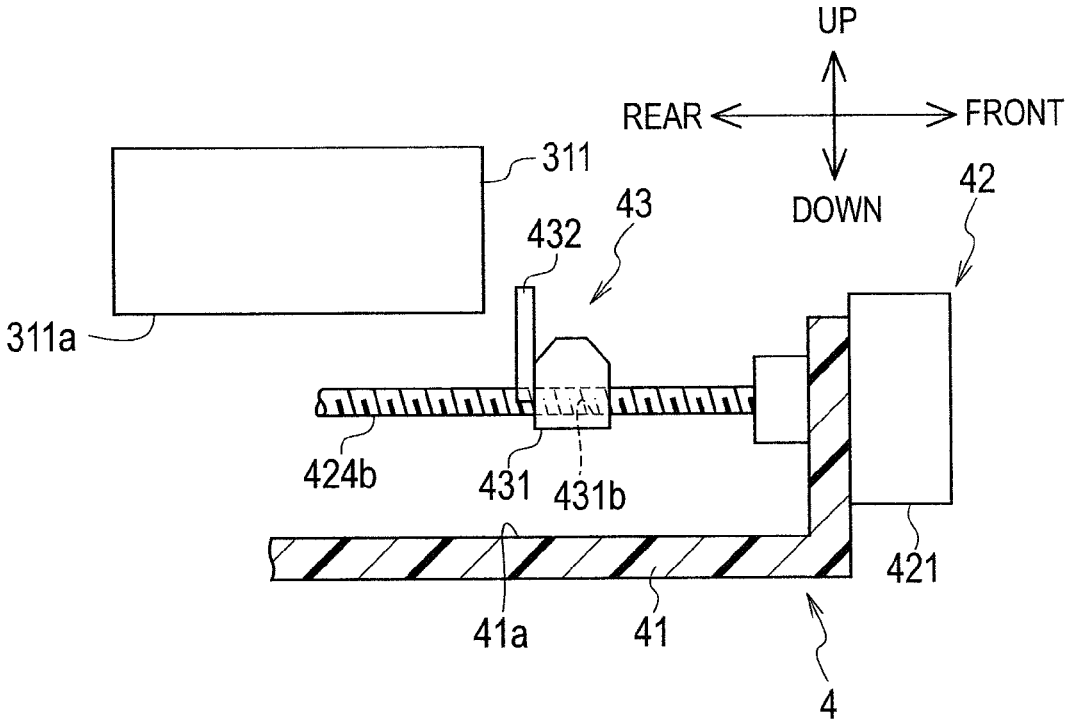
FIG. 8 is a section along line A-A of FIG. 6.
Figure 9:
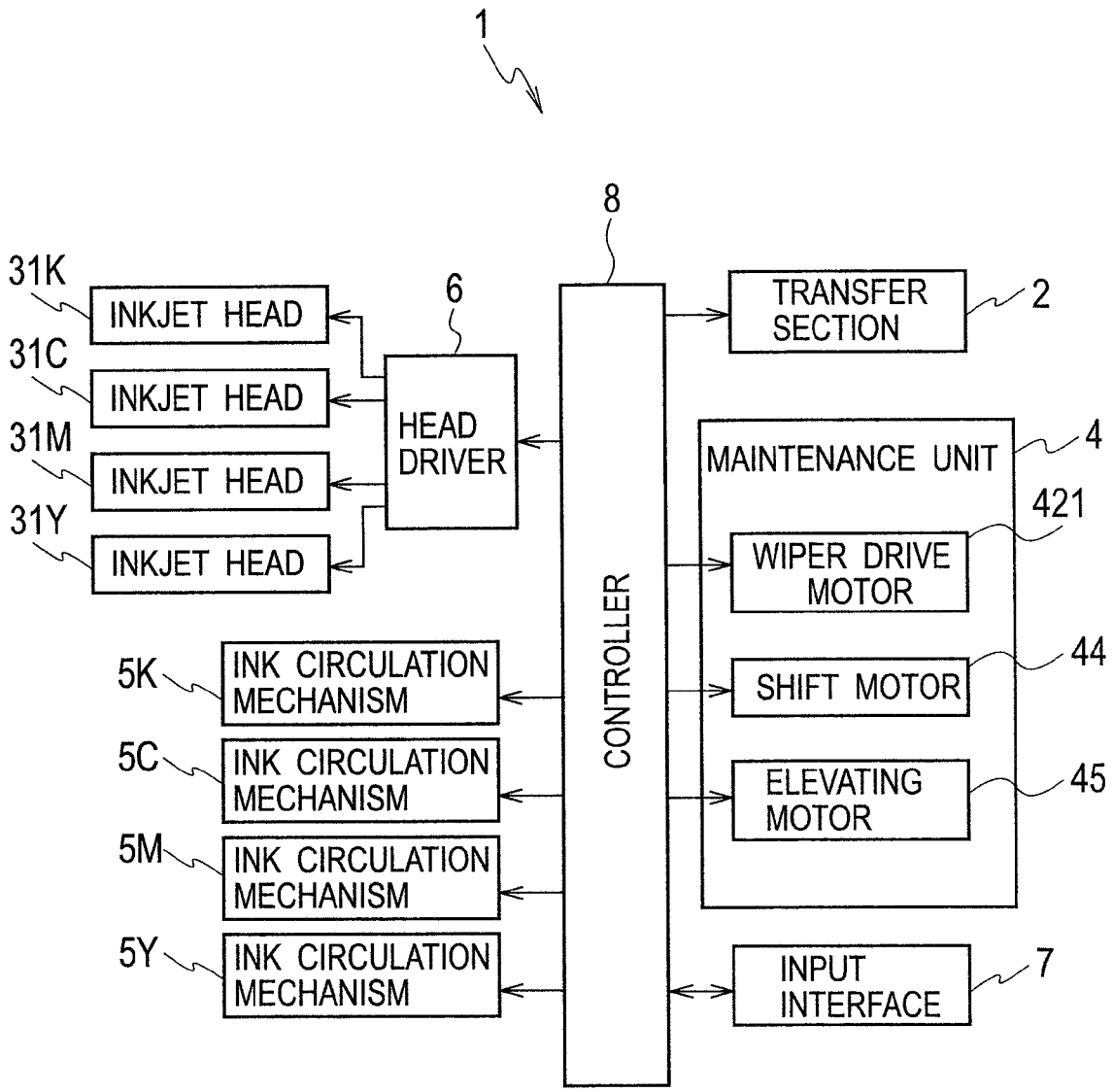
FIG. 9 is a block diagram showing configuration of a control system of the inkjet printer illustrated in FIG. 1.

FIG. 1 is an illustration of schematic configuration of an inkjet printer according to an embodiment of the present invention. FIG. 2 is an illustration of schematic configuration of an ink circulation mechanism FIG. 3 is a perspective view, partly in section, of schematic configuration of a unit head constituting an inkjet head. FIG. 4 is a section along line A-A of FIG. 3. FIG. 5 is a section along line B-B of FIG. 3. FIG. 6 is a plan view of a maintenance unit. FIG. 7 is an exploded perspective view including the maintenance unit and a set of inkjet heads. FIG. 8 is a section along line A-A of FIG. 6. FIG. 9 is a block diagram showing configuration of a control system of the inkjet printer illustrated in FIG. 1. There will be use of a direction system assuming a user looking at FIG. 1 from the front. FIG. 1 illustrates two transverse senses and two vertical senses, as they are seen from the user.

As illustrated in FIG. 1, according to this embodiment, an inkjet printer 1 includes a transfer section 2, a head unit 3, and a maintenance unit 4.

The transfer section 2 includes a transfer belt 21, a drive roller 22 for driving the transfer belt 21 to have go around, and driven rollers 23, 24, and 25 driven from the drive roller 22.

The transfer belt 21 is stretched over the drive roller 22 and the driven rollers 23, 24, and 25. For print services, it is driven by the drive roller 22, to move in an endless manner, while carrying, by holding thereon, a print sheet fed from a sheet feeder (non-depicted) arranged at the left.

The transfer section 2 is vertically movable between its service position, where it can serve for printing, and its retreat position set therebelow. The transfer section 2 is shifted to the retreat position, as necessary, to shift the maintenance unit 4 to a position between the transfer section 2 and the head unit 3, to provide a maintenance service to the head unit 3.

The head unit 3 is composed of line type inkjet heads 31K, 31C, 31M, and 31Y each configured to propel out droplets of ink onto a sheet being transferred by the transfer belt 21, to print images thereon. The inkjet heads 31K, 31C, 31M, and 31Y are transversely arrayed at prescribed intervals above the transfer section 2. The inkjet heads 31 K, 31 C, 31M, and 31Y are adapted to discharge different types of ink, such that K (black), C (cyan), M (magenta), and Y (yellow), respectively.

As illustrated in FIG. 6 and FIG. 7, the inkjet head 31K is comprised of a set of six unit heads 311K arrayed in a 3×2 staggered matrix. Also the inkjet head 31C, 31M, or 31Y is comprised of a set of similarly arranged six unit heads 311 C, 311M, or 311Y, respectively.

For some phrases herein understandable without identification of color or such, there will be use of reference signs omitting their color identifying alphabetical suffixes (K, C, M, Y), such as '31' representing one or more inkjet heads, or '311' representing one or more unit heads, for instance.

The inkjet printer 1 is an ink circulation type inkjet printer that has an ink circulation system including an array of ink circulation mechanisms 5 (5K, 5C, 5M, and 5Y) each adapted for circulation of ink from an inkbottle, as illustrated in FIG. 2. The ink circulation mechanisms 5 (5K, 5C, 5M, and 5Y) are associated with the inkjet heads 31K, 31C, 31M, and 31Y, respectively.

As shown in FIG. 2, at a respective ink circulation mechanism 5, there is an arrangement including an inkbottle 51, an upstream tank 52, a downstream tank 53, and a pump 54. The ink circulation mechanism 5 has an ink supply route DR extending from the inkbottle 51 to the downstream tank 53, and an ink circulation route CR extending from the downstream tank 53, through the upstream tank 52, to an inkjet head 31, returning therefrom to the downstream tank 53.

There is a flow of ink supplied from the inkbottle 51, and conducted along the supply route DR to the downstream tank 53, where it is pooled for temporary residence. At the circulation route CR, the pump 54 is operable to pump part of ink residing in the downstream tank 53 to the upstream tank 52, to supply therefrom to the inkjet head 31. The inkjet head 31 consumes part of supplied ink for a printing service, the rest being returned to the downstream tank 53. The consumption of ink for the printing service is supplemented from the inkbottle 51 to the downstream tank 53, along the supply route DR that has an open-close operable valve (referred herein to as an "open close valve") 55 installed thereon.

The inkjet head 31 has a distributor (non-depicted) for distribution of ink to respective unit heads 311 therein, and a collector (non-depicted) for collecting unused ink after printing at the unit heads 311.

The inkjet head 31 has nozzle header faces therein arrayed in position higher than the downstream tank 53, and the upstream tank 52 is disposed in position higher than the nozzle header faces of the inkjet head 31. Such the positional relationships ensure sufficient head differences for ink supply from the upstream tank 52 to the inkjet head 31 and ink return from the inkjet head 31 to the downstream tank 53.

The upstream tank 52 and the downstream tank 53 are each provided with an atmospheric release valve 521 or 531 operable to exchange the inside of tank between a tight sealed state and an atmospheric open state. It is noted that the circulation route CR has an open close vale 56 installed thereon between the inkjet head 31 and the downstream tank 53.

For maintenance services, there is use of an ink supply line as a route to the inkjet head 31, in a pressurized state for pressing ink to spill out of the inkjet head 31, to implement a purge operation, when the pump 54 is operated with the atmospheric release valve 53 of the upstream tank 52 closed for a tight sealing, and the open close valve 56 shut to close a return line as a route from the inkjet head 31 to the downstream tank 53. This enables the ink supply line to the inkjet head 31 to serve, in a pressurized state, for pressing ink to spill out of the inkjet head 31. The pump 54 is thus adapted to function as a pressurizer in this embodiment.

At the inkjet head 31, as illustrated in FIG. 3 through FIG. 5, a respective one of the unit heads 311 has a substrate 11 made of ceramics or the like, a cover plate 12, and an array of partition walls 13 each respectively disposed in between and composed of a pair of piezoelectric members 13*a* and 13*b*. The paired piezoelectric members 13*a* and 13*b* are made of a known piezoelectric material such as PZT ($PbZrO_3$—$PbTiO_3$). The piezoelectric members 13*a* and 13*b* are polarized in different directions, as indicated by arrows in FIG. 5.

The substrate 11, cover plate 12, and partition walls 3 are arranged to abut at their distal ends on a nozzle header or nozzle plate 14 fixed thereto. There is an array of parallel ink chambers 15 thus enclosed with and defined by the substrate 11, cover plate 12, partition walls 3, and nozzle plate 4. The nozzle plate 14 has an array of nozzles 16 formed therethrough. Each ink chamber 15 is communicating with a nozzle 16 at its distal end. At the opposite end, the ink chamber 15 is communicating with an ink inlet 17. As illustrated in FIG. 4, the ink inlet 17 is covered with a lid member 18. The arrayed ink chambers 15 are all communicating with the ink inlet 17. The ink inlet 17 is supplied with ink through the circulation route CR.

Any ink chamber 15 is defined at both lateral sides thereof with partition walls 13, and at a bottom thereof with the substrate 11, where their surfaces have an electrode 19 formed thereon and cohesive therewith. In the ink chamber 15, the electrode 19 is extended over surfaces of rear parts of piezoelectric members 13*a*. Each electrode 19 is connected through an anisotropic conductive film (non-depicted) to a flexible cable 20. Drive voltages are applied through the flexible cable 20 to each electrode 19.

The electrode 19 works in accordance with a drive voltage applied thereto, to have partition walls 13 deform in a shearing manner, thereby changing a volume of the ink chamber 15, and pressures in the ink chamber 15. This propels a droplet of ink through the nozzle 16 of the ink chamber 15.

The maintenance unit 4 is configured to give a cleaning to surfaces of nozzle plates 14 constituting nozzle header faces in each inkjet head 31. For printing services, the maintenance unit 4 is located in a waiting position indicated by solid lines in FIG. 1. The waiting position is set at a lower right of the transfer section 2. For maintenance services, the maintenance unit 4 is shifted to its service position for maintenance that is indicated by broken lines in FIG. 1. This maintenance service position is set between the transfer section 2 and the array of inkjet heads 31.

As shown in FIG. 6 through FIG. 9, the maintenance unit 4 includes an ink receiving member 41, a drive section 42, a wiper section 43, a shift motor 44, and an elevating motor 45. It is noted that, in FIG. 6 through FIG. 8, there is shown a state of maintenance unit 4 set in the maintenance service position.

The ink receiving member 41 serves to receive ink and the like removed by cleaning. The ink receiving member 41 is configured to hold members of the maintenance unit 4. The ink receiving member 41 is formed in a parallelepiped shape. The ink receiving member 41 has a setback portion 41*a* formed at a central portion thereof to receive ink and the like. The setback portion 41*a* is greater in plan than a region for accommodating the inkjet heads 31. The ink receiving member 41 is open at the top.

The drive section 42 is configured to longitudinally displace the wiper section 43 in maintenance services. The drive section 42 includes a wiper drive motor 421, a drive belt 422, a pair of drive pulleys 423*a* and 423*b*, and a pair of screw feed shafts 424*a* and 424*b*.

The wiper drive motor 421 produces rotation torque. The wiper drive motor 421 is disposed on the outside of a front of the ink receiving member 41. The wiper drive motor 421 has an output pulley or gear 421*a*. The output gear 421*a* transmits rotation torque of the wiper drive motor 421 to the drive belt 422. The output gear 421*a* is disposed at a center of the drive belt 422. The drive belt 422 transmits rotation torque transmitted from the wiper drive motor 421, to the drive pulleys 423*a* and 423*b*. The drive belt 422 is stretched over the drive pulley 423*a* and the drive pulley 423*b*.

The paired drive pulleys 423*a* and 423*b* transmit rotation torque transmitted from the drive belt 422, to the screw feed shafts 424*a* and 424*b*. The drive pulley 423*a* and the drive pulley 423*b* are arranged at a level, and transversely spaced at a distance from each other. The drive pulleys 423*a* and 423*b* are rotatably supported at a front portion of the ink receiving member 41.

The screw feed shafts 424*a* and 424*b* employ rotation torque transmitted from the wiper drive motor 421, to longitudinally displace the wiper section 43. The screw feed shafts 424*a* and 424*b* extend substantially over longitudinal length of the setback portion 41*a*. The screw feed shafts 424*a* and 424*b* have their front ends fixed to rear ends of the drive pulleys 423*a* and 423*b*, respectively. The screw feed shafts 424*a* and 424*b* have their rear ends rotatably supported on a rear wall of the ink receiving member 41. By such arrangement, the screw feed shafts 424*a* and 424*b* revolve, as the drive pulleys 423*a* and 423*b* rotate.

The wiper section 43 works in each maintenance service to wipe nozzle header faces 311*a* of unit heads 311 of the inkjet heads 31, to remove ink and the like adhering on the nozzle header faces 311*a*, and has a mount member 431 and an array of eight wipers 432.

The mount member 431 is composed of a transversely elongate prismatic member arranged to mount the wipers 432 thereon. The mount member 431 has a pair of screw holes 431*a* and 431*b* formed therethrough. The screw holes 431*a* and 431*b* are screwed on the screw feed shafts 424*a* and 424*b* provided therethrough, respectively. The mount member 431 is longitudinally displaced, as the screw feed shafts 424*a* and 424*b* revolve.

The wipers 432 are each arranged to slide on nozzle header faces 311 a of an array of unit heads 311 of the inkjet heads 31, removing ink and the like thereon. Each wiper 423 is made of an elastic deformable material such as rubber. For each wiper 432, the material used may well be a material so elastic as not to break the nozzle header face 311*a*. Each wiper 423 is shaped in a rectangular sheet form. Each wiper 423 is fixed at a lower end thereof to a rear side of the mount member 431, using a fixture (non-depicted). As illustrated in FIG. 6, the eight wipers 432 are disposed, in plan, on extensions of longitudinal arrays of unit heads 311. As illustrated in FIG. 8, each wiper 432 has an upper end thereof at a level higher than a top face of the mount member 431. In the maintenance service position, the wipers 432 are arranged to have their upper ends at a higher level than nozzle header faces 31 la of arrays of unit heads 311. By such arrangement, when longitudinally displaced, the wipers 432 contact unit heads 311, and elastically deform, sliding on their nozzle header faces 311*a*.

The shift motor 44 is adapted to shift the maintenance unit 4 between the waiting position shown in FIG. 1 and a later-described retreat position.

The elevating motor 45 is adapted to vertically shift the maintenance unit 4 together with the transfer section 4. As will be seen from FIG. 1, this arrangement serves to shift the transfer section 2 and the maintenance unit 4, between their service positions for maintenance or printing and their retreat positions.

As shown in FIG. 9, the inkjet printer 1 includes a head driver 6, an input interface 7, and a controller 8.

The head driver 6 is adapted to drive the inkjet heads 31 to discharge ink. More specifically, the head driver 6 applies drive voltages through flexible cables 20 to electrodes 19 in unit heads 311, whereby associated partition walls 13 are deformed, changing volumes of ink chambers 15 and pressures in ink chambers 15, propelling droplets of ink through associated nozzles 16.

The input interface 7 has various operation buttons (non-depicted), touch panels (non-depicted), and the like, and is adapted for accepting user operations to output operation signals corresponding to such operations.

The controller 8 includes a CPU (non-depicted), memories (non-depicted), and the like, and is configured to govern actions in the entirety of inkjet printer 1.

For maintenance services to the inkjet heads 31, the controller 8 is adapted to control the head driver 6 to control the ink circulation mechanisms 5, for use of ink supply lines as their routes to inkjet heads 31, in a pressurized state for a prescribed period, for pressing fluxes of ink to spill out of the inkjet heads 31, before driving the inkjet heads 31 for their discharge operations.

Description is now made of maintenance operations in the inkjet printer 1.

Maintenance operations are performed at various timings such as prescribed ones, or when a start instruction is input by a user operating the input interface 7.

Figure 10:
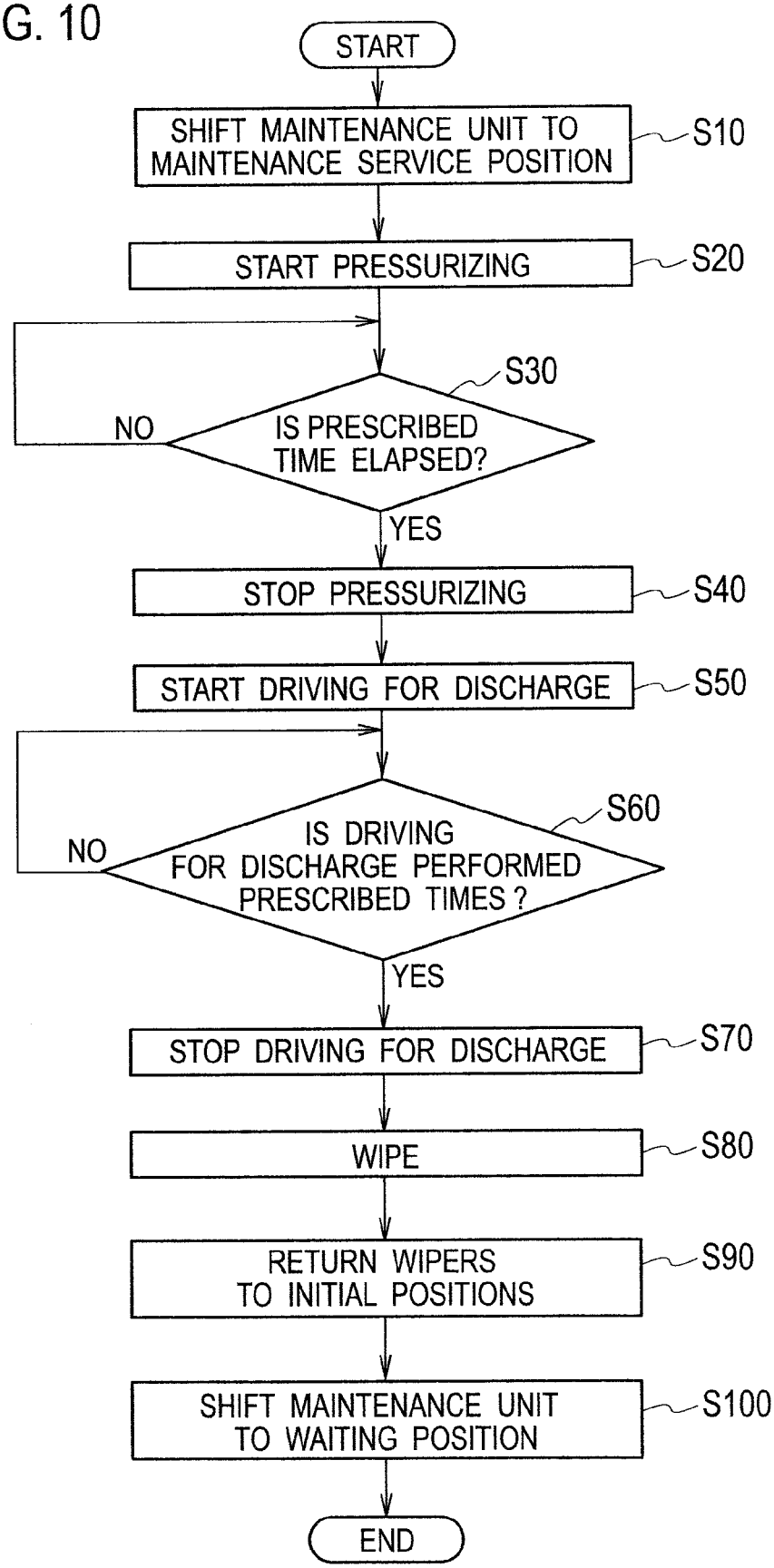
FIG. 10 is a flowchart showing a procedure of maintenance operations in the inkjet printer illustrated in FIG. 1.

FIG. 10 is a flowchart showing a procedure of maintenance operations in the inkjet printer 1.

Figure 11:
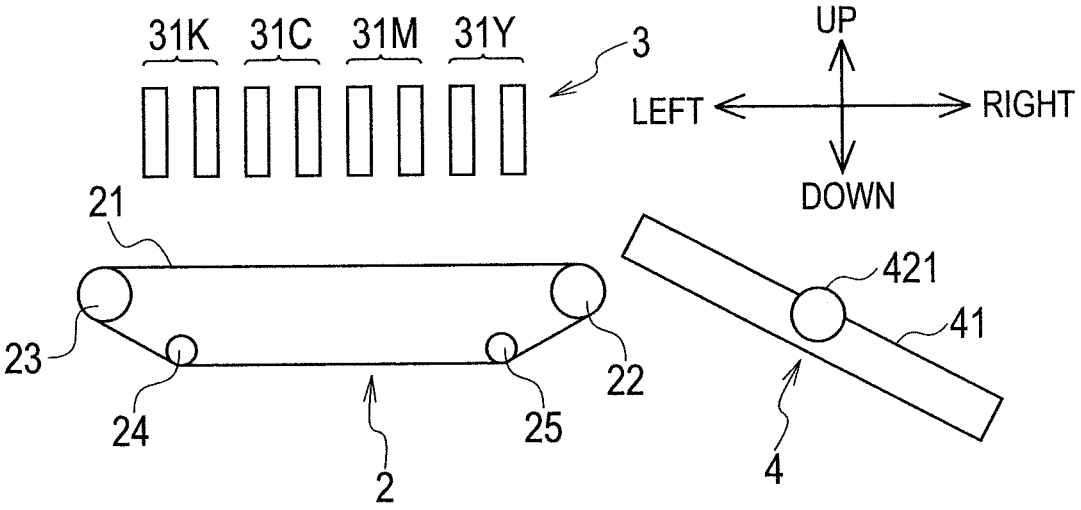
FIG. 11 is an illustration describing a shift operation of the maintenance unit.
Figure 12:
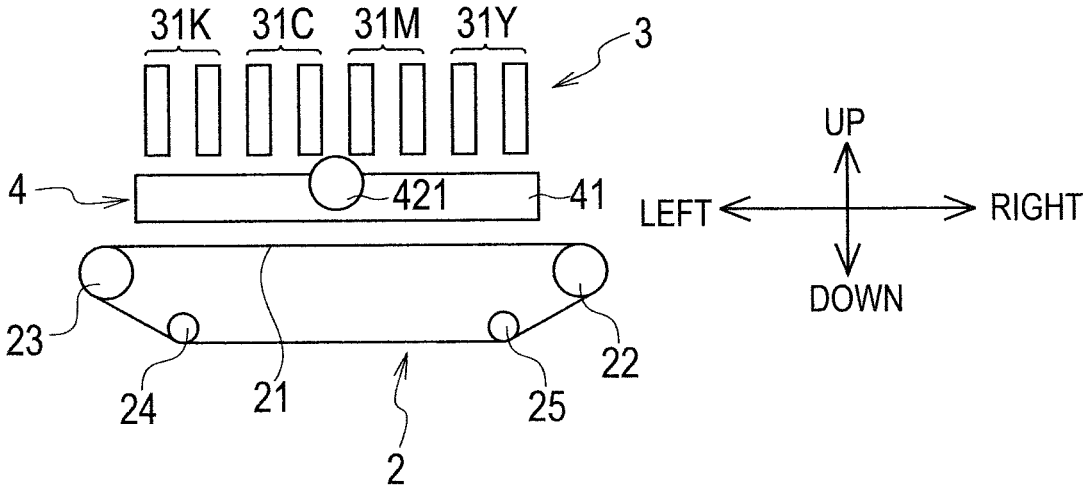
FIG. 12 is an illustration describing another shift operation of the maintenance unit.
Figure 13:
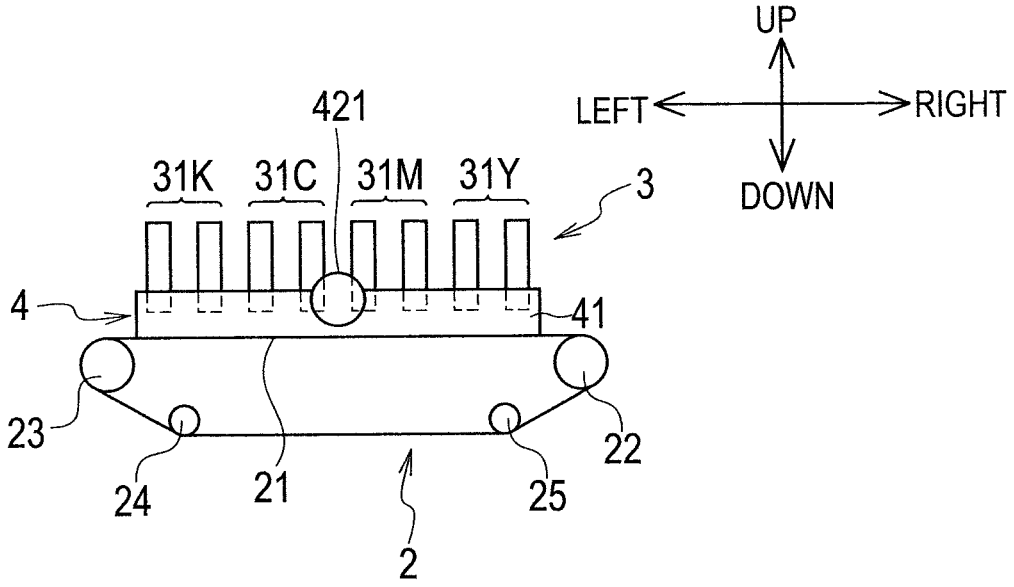
FIG. 13 is an illustration describing still another shift operation of the maintenance unit.

First, at a step S10, the controller 8 operates to shift the maintenance unit 4 to its service position for maintenance. In a course of this operation, first, as shown in FIG. 11, the controller 8 drives the elevating motor 45 to shift the transfer section 2 from the print service position, downward to its retreat position. Then, as shown in FIG. 12, the controller 8 drives the shift motor 44 to shift the maintenance unit 4 from the waiting position, upper-leftward to its retreat position. Afterward, as shown in FIG. 13, the controller 8 drives the elevating motor 45 to shift the transfer section 2 from its retreat position, upward to its service position now serving for maintenance. The maintenance unit 4 is thereby shifted from its retreat position to its service position for maintenance. As illustrated in FIG. 8, when the maintenance unit 4 is set in the maintenance service position, the wipers 432 have their upper ends at a higher level than nozzle header faces 311*a* of unit heads 311 arrayed in the inkjet heads 31. In FIG. 6, the wipers 432 are set in positions in front of longitudinally foremost unit heads 311.

Then, at a step S20, the controller 8 operates to control each ink circulation mechanism 5 to start pressurizing the ink supply line to the inkjet head 31, for a purge operation to exert pressures on ink, to spill ink out of the inkjet head 31. More specifically, the controller 8 operates for each mechanism 5, to shut the atmosphere release valve 521 at the upstream tank 52, sealing this tight, and shut the open close valve 56 to close the return line from the inkjet head 31 to the downstream tank 53. Under this condition, the controller 8 operates to drive the pump 54. This operation pressurizes the ink supply line to the inkjet head 31 in the ink circulation route CR. At each unit head 311, residual ink is thereby expelled out of the nozzles 16.

Then, at a step S30, the controller 8 operates to determine whether or not a prescribed time set in advance has elapsed since the start of pressurization. If the prescribed time has elapsed (YES at the step S30), the flow goes to a step S40. Unless the prescribed time has elapsed (NO at the step S30), the controller 8 operates for control to continue the pressurization until the prescribed time elapses.

At the step S40, the controller 8 controls each ink circulation mechanism 5 to end the pressurization started at the step S20, to end the purge operation. More specifically, the controller 8 operates to stop driving the pump 54, and open the atmosphere release valve 521 at the upstream tank 52, and the open close valve 56.

Figure 14:
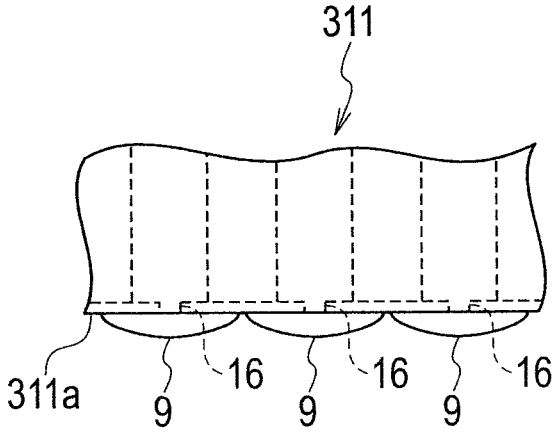
FIG. 14 is an illustration of a pseudo-capped state.

At each unit head 311, as illustrated in FIG. 14, there is a system of spills 9 of ink spilt by the purge operation, and spread over the nozzle header face 311 a, covering nozzles 16 therein. It renders the nozzles 16 capped (or quasi-capped) with associated ink spills 9.

Figure 15:
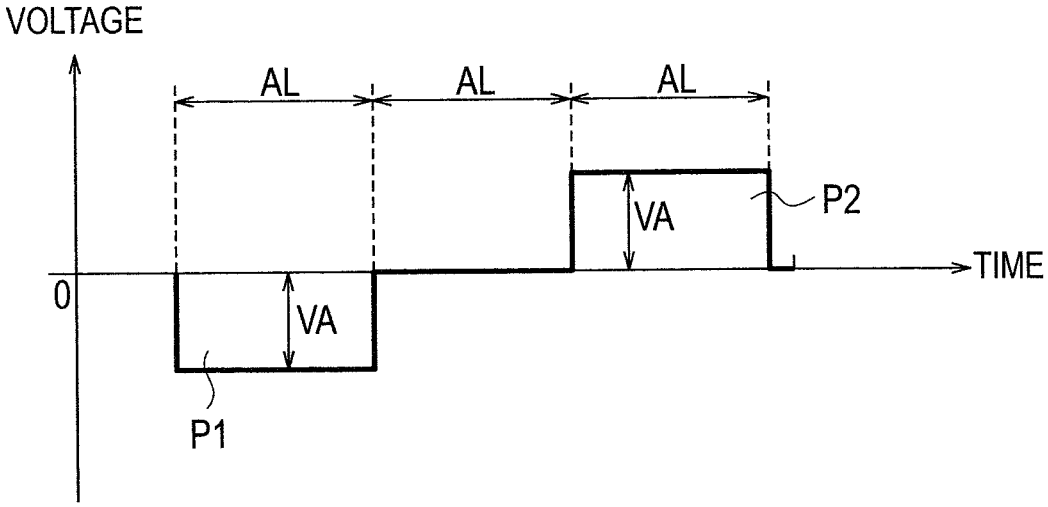
FIG. 15 is a chart showing an example of driving waveform for inkjet head.

Then, at a step S50, the controller 8 operates for control of the head driver 6 to start driving each inkjet head 31 for discharge (for flushing). The head driver 6 is then serving to apply voltage sequences each constituting such a waveform as illustrated in FIG. 15, to electrodes 19 in each unit head 311. FIG. 15 shows, in a time chart, a waveform consisting of a sequence of voltages applied to an electrode 19 for a single discharge operation.

Description is now made of discharge actions responding to such voltages as shown in FIG. 15, as they are sequentially applied to electrodes 19 in a unit head 311. This description is addressed to discharge actions at and about a central ink chamber 15 in FIG. 5.

Figure 16:
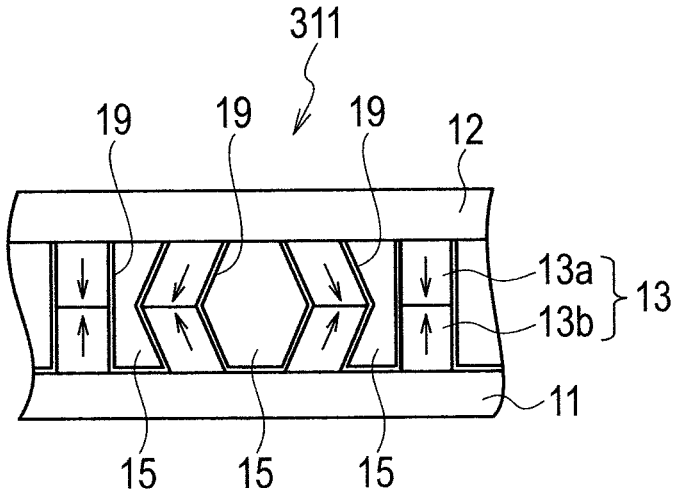
FIG. 16 is an illustration describing a combination of ink propelling actions at the inkjet head.

Starting with a steady state illustrated in FIG. 5, the head driver 6 operates to ground electrodes 19 of ink chambers 15 neighboring on both sides of the central ink chamber 15 as a target of discharge operation in the figure, and apply an expansion pulse P1 with a negative voltage—$V_A$ shown in FIG. 15, t an electrode 19 of the central ink chamber 15. This operation develops electric fields with their directions perpendicular to directions of polarization of those piezoelectric members 13*a* and 13*b* constituting partition walls 13 at both sides of the central ink chamber 15. These phenomena cause paired piezoelectric members 13*a* and 13*b* to deform in a shearing manner at joints in between, respectively, so as illustrated in FIG. 16, the partition walls 13 at both sides of the central ink chamber 15 deform in mutually seceding directions, causing the central ink chamber 15 to have an expanded volume. As a result, the central ink chamber 15 has a negative pressure developed therein, forcing a flux of ink to inflow from the ink inlet 17 to the central ink chamber 15. The expansion pulse P1 has a pulse length of one AL (acoustic length). At the ink chamber 15 with an expanded volume, inflowing ink has a pressure wave propagated over length of the ink chamber 15 up to a corresponding nozzle 16, taking an interval of time, which is represented by the AL, of which value depends the structure of unit head 311, density of ink, etc.

After the application of expansion pulse P1, as shown in FIG. 15, the head driver 6 operates to return the applied voltage to a ground potential. This operation causes the partition walls 13 at both sides of the central ink chamber 15 to return from their states in FIG. 16 to such neutral positions as illustrated in FIG. 5. As a result, the central ink chamber 15 has ink pressures therein suddenly increased, discharging through the corresponding nozzle 16.

Figure 17:
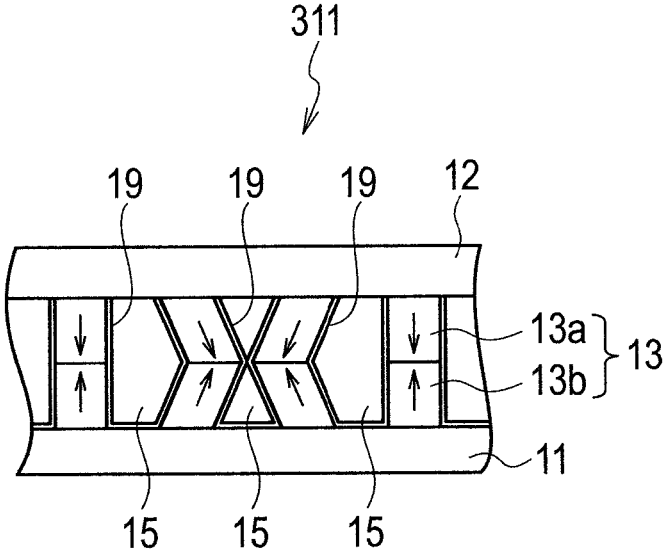
FIG. 17 is an illustration describing another combination of ink propelling actions at the inkjet head.

With an intermission of one AL elapsed after the voltage applied to the electrode 19 of the central ink chamber 15 returned to the ground potential, the head driver 6 operates to apply a contraction pulse P2 of a positive voltage $V_A$ to the electrode 19 of the central ink chamber 15. The contraction pulse P2 has a pulse length of one AL. With the contraction pulse P2 applied, as illustrated in FIG. 17, the partition walls 13 at both sides of the central ink chamber 15 deform in mutually approaching directions, causing the central ink chamber 15 to have a contracted volume.

At the ink chamber 15, promptly after the application of expansion pulse P1 was ended, there was an inner pressure reaching a peak, whereby ink was discharged. After the pressure was peaked, the ink chamber 15 has had a negative pressure developed therein. At such the ink chamber 15, with the contraction pulse P2 applied, the chamber volume is contracted, producing an increasing pressure, so after the ink discharge the ink chamber 15 has a suppressed negative pressure, which attenuates residual vibrations of ink in the ink chamber 15. This allows for a subsequent discharge operation to be stable.

After the application of contraction pulse P2, the head driver 6 operates to return the voltage applied to the electrode 19 of the central ink chamber 15, to a ground potential, restoring the state in FIG. 5. Through the foregoing actions, there comes an end of a single time of discharge operation.

It is noted that illustrated in FIG. 3 through FIG. 5 is part of (a unit head 311 in) a share mode type inkjet head. Such the type of inkjet head makes use of deformations of partition walls 13 to discharge ink, as described, and does not afford to drive mutually neighboring ink chambers 15 for simultaneous discharge. For such the reason, the controller 8 is adapted to operate for each unit head 311, to divide a whole number of ink chambers 15 therein into three groups, by taking every one at intervals of two to constitute a group. The controller 8 is then operable to sequentially drive ink chambers 15 in each group to discharge ink at associated nozzles 16, to complete a driving of the three groups as one cycle, before repeating this to implement a driving control, as necessary.

In this embodiment, each nozzle 16 is programmed to perform a discharge operation a prescribed number of times (e.g. several tens of times). Referring again to FIG. 10, at a step S60, the controller 8 operates to determine whether or not respective nozzles 16 have completed their discharge operations a prescribed number of times. If those discharge operations have been completed the prescribed number of times (YES at the step S60), the flow goes to a step S70, where the controller 8 operates for control of the head driver 6 to stop driving for discharge (for flushing). Unless the discharge operations have been completed the prescribed number of times (NO at the step S60), the controller 8 operates for control of the head driver 6 to keep driving for discharge, until the discharge operations become completed the prescribed number of times.

Figure 18:
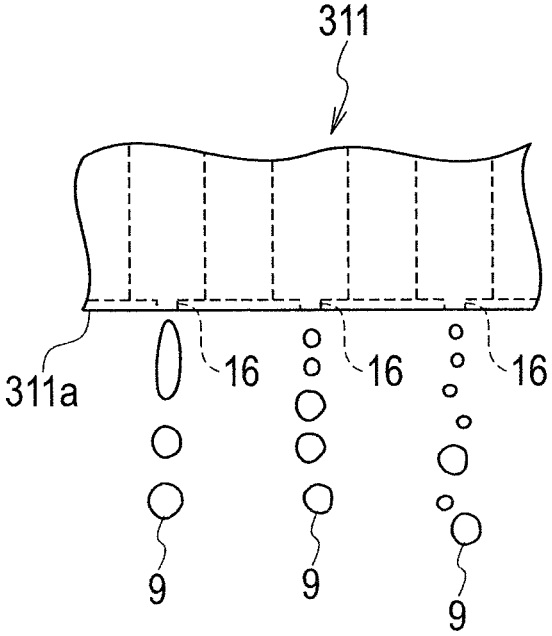
FIG. 18 is an illustration of ink droplets being propelled out in a flushing operation in the past.
Figure 19:
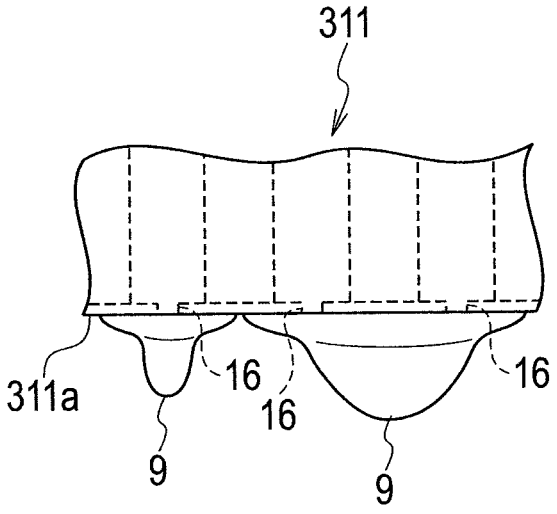
FIG. 19 is an illustration of a pseudo-capped state of ink propelling nozzle header face.

The above-noted driving for discharge is performed in such a quasi-capped state as illustrated in FIG. 14. In flushing operations in the past, there were ink droplets propelled out as illustrated in FIG. 18, so discharged ink particles and ink mist were left as they were free to float about in the printer, causing contamination in the printer, thus needing provision of implements such as for suctioning, to collect, discharged ink particles and ink mist. To this point, according to this embodiment, there is a quasi-capped state established with a spill 9 of ink covering a nozzle 16, so even in a discharge operation exerting increased pressures on wall of the nozzle 16, such pressures undergo pressure losses at the nozzle 16, whereby the spill 9 of ink spilt on a nozzle header face 311 a is kept from experiencing undue high pressures exerted thereon. Further, there is a system of spills 9 of ink spread over the nozzle header face 311 a, acting on fluxes of ink coming out of nozzles 16 under discharge operation, to disperse them, keeping them from being discharged as ink droplets. Hence, as illustrated in FIG. 19, at a respective nozzle in a quasi-capped state, when this is subjected to a discharge operation, there appears a spill 9 of ink developed like a brimmed cap or pool on the nozzle header face 311 a, with tendencies to drip. Such the state allows for suppressed flying of ink particles or ink mist. At respective nozzles, there are attached matters and the like expelled out thereof together with fluxes of ink subjected to discharge operations.

As the driving for discharge is ended, there comes a step S80, where the controller 8 operates to drive the wiper drive motor 421, to displace the array of wipers 432, thereby wiping the inkjet heads 31.

With the wiper drive motor 421 energized, the wiper drive motor 421 produces rotation torque, which is transmitted through the output gear 421*a*, drive belt 422, and drive pulleys 423*a* and 423*b*, to force the screw feed shafts 424*a* and 424*b* to revolve. As a result, the mount member 431 screwed on the screw feed shafts 424*a* and 424*b* is displaced rearward, together with the array of wipers 432. As wipers 432 are displaced in position to have their upper parts contacting on unit heads 311, these unit heads 311 press the wipers 432, causing them to elastically deform. Under this condition, as the wipers 432 are still displaced rearward, back sides of the wipers 432 slide on nozzle header faces 311*a* of the unit heads 311.

Such the wiping is effective to remove spills 9 of ink spilt on the nozzle header faces 311*a*, together with dusts adhering on the nozzle header faces 311*a*. This allows for adapted state for normal ink discharge. The wiper array 432 is displaced rearward, in position past rearmost unit heads 311, when the controller 8 operates to stop the wiper drive motor 421, whereby the mount member 431 as well as the wiper array 432 is stopped. It is noted that, for positional detection of the wiper array 432, the controller 8 is adapted for access to a set of positional detection sensors, a rotary encoder, or such.

Then, at a step S90, the controller 8 operates for control to return the wiper array 432 to its initial position. More specifically, the controller 8 operates to drive the elevating motor 45, to shift the maintenance unit 4 together with the transfer section 2, downward to its retreat position. At this retreat position, the wipers have their upper ends at a level lower than the nozzle header faces 311*a* of unit heads 311. Then, the controller 8 operates to drive the wiper drive motor 421, to displace the wiper array 432 forward, and to stop the wiper drive motor 421 when the wiper array 432 is displaced to the initial position shown in FIG. 6. It is noted that the maintenance unit 4 is now set in the retreat position, so the wipers 432 can be displaced without contacting unit heads 311.

Then, at a step S100, the controller 8 operates to drive the shift motor 44, to shift the maintenance unit 4 to the waiting position shown by solid lines in FIG. 1. Then, the controller 8 operates to drive the elevating motor 45, to shift the transfer section 2 to the print service position shown in FIG. 1. With the foregoing complete, there comes an end of a series of maintenance operations.

As will be seen from the foregoing description, according to this embodiment, there is a series of maintenance operations including a purge operation for establishing quasi-capped states of nozzles 16 with spills 9 of ink spread on nozzle header faces 311*a*, followed by driving an inkjet head 31 under that condition, for discharge (for flushing). This allows for suppressed flying of ink particles or ink mist, with suppressed contamination in the printer.

There is no need to provide, among others, a set of caps for covering unit heads 311, and an arrangement for sucking, to collect, fluxes of ink and ink mist discharged by flushing operations, including a suction pump and the like, there being nothing to invite increased complexity in arrangement and enlargement in size of the printer, allowing for suppressed contamination in the printer.

It is noted that this embodiment includes a purge operation to complete a pressurization of ink line, before driving an inkjet head 31 for discharge operation, while there may be a pressurization of ink line continued even after initiation of discharge operation. For instance, there may be a pressurization of ink line continued until discharge operations become completed a prescribed number of times.

When driving an inkjet head 31 for discharge under a quasi-capped condition, there may be nozzles 16 found with effluxes of ink due to driving for discharge, giving rise to increased quantities of ink constituting quasi-caps, with anxiety about some of them tending to drop off at nozzle header faces 311*a*. At any nozzle 16 covered with a spill 9 of ink (as a quasi-cap), if the spill 9 of ink drops off, then as illustrated in FIG. 18, there appear droplets of ink being propelled out by driving for discharge, like a normal flushing operation. Such the state involves ink particles or ink mist flying away, causing contamination in the printer.

To this point, there may well be a pressurization of ink line continued even after initiation of driving for discharge, affording to supply nozzle header faces 311*a* with spills of ink split out of nozzles 16 by the pressurization of ink line, permitting a system of quasi-caps to be maintained, even if ink spills drop off. Such arrangement allows for suppressed flying of ink particles or ink mist, with suppressed contamination in the printer.

Further, when driving an inkjet head 31 for discharge, there may well be higher pressures exerted on nozzles 16 to drive the inkjet head 31, than for driving for discharge in normal print services.

In normal print services, the before-mentioned waveform of FIG. 15 is selected at the head driver 6 as a waveform for driving (as a normal waveform). In this respect, for exerting higher pressures on nozzles 16, the head driver 6 is adapted to select such a drive waveform as illustrated in FIG. 20, to apply commensurate voltages to electrodes 19.

Figure 20:
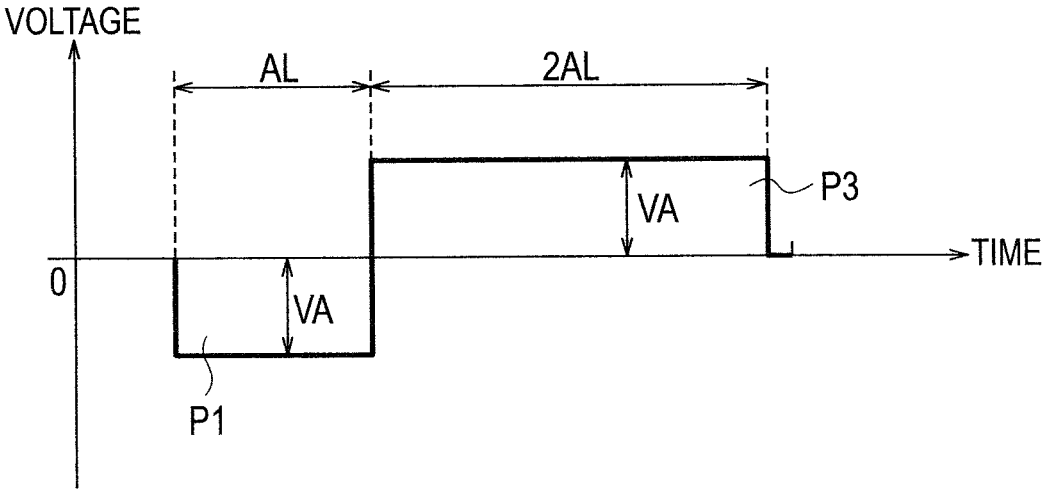
FIG. 20 is a chart showing another example of driving waveform for inkjet head.

Unlike the normal waveform in FIG. 15 including an intermission between expansion pulse P1 and contraction pulse P2, the drive waveform in FIG. 20 has an expansion pulse P1 directly followed by a contraction pulse P3 of a positive voltage $V_A$ to be applied to electrodes 19, without intermission in between. Hence, at ink chambers 15 being operated, the state in FIG. 16 is directly changed to the state in FIG. 17, whereby those ink chambers 15 have ink fluxes therein under suddenly increased pressures, exerting high pressures on walls of associated nozzles 16. As a result, even in inkjet heads 31 under conditions having attached matter or such unable to remove by discharge operations similar to those in the normal print service, and difficult to restore inherent discharge performances, it is possible to exert high pressures on nozzles 16, to remove attached matter or such, allowing for a restored discharge performance.

It is noted that not only the waveform shown in FIG. 20, there may well be use of any drive waveform affording to exert higher pressures on nozzles 16 than in use of the normal waveform.

This embodiment employs a purge operation for pressurizing an ink line for a prescribed period of time, which period for pressurization may well be varied depending on an environmental temperature.

Under environments with low temperatures, the viscosity of ink is large, so when purged, ink is difficult to spill out. On the contrary, under environments with high temperatures, the viscosity of ink is small, so when purged, ink is spilt out with ease. Therefore, when purging, as the environment temperature decreases, the period for pressurization may well be increased, as necessary to expel adequate volumes of ink at nozzles 16 in service.

Further, for purge operations, the pressurization period may well be set up by user operating the input interface 7.

According to this embodiment, for inkjet heads 31 under maintenance service, there is a default period of time for discharge operation, which period may well be otherwise set by user operating the input interface 7. In this case, the controller 8 may well be adapted for control of the head driver 6 to perform the discharge operation as many times as possible within the set period. By doing so, user is allowed to see a printing, to check for occurrence of discharge troubles, estimating the degree, to work on the estimation, to set up a period (as number of times) of discharge operation for maintenance service.

The embodiment described is addressed to a line type inkjet printer, while the present invention not limited thereto is applicable to other types of inkjet printer else than the line type inkjet printer, as well.

Further, the embodiment described is addressed to an ink circulation type inkjet printer, while the present invention is applicable also to inkjet printers of those types in which ink is not circulated.

Further, the embodiment described is addressed to an inkjet printer including a share mode inkjet head, while the present invention not limited thereto is applicable to inkjet printers including other modes of inkjet heads, as well.

Such being the case, the embodiment described is illustrative to show specific modes of a technical concept according to the present invention, and not restrictive in any way to limit arrangement of components to what is described according to the technical concept of the present invention. The technical concept of the present invention can be altered, changed or modified in various manners, within the scope of appended claims. The present application claims the benefit of priority under 35U.S.C.§119 to Japanese Patent Application No. 2010-166921, filed on Jul. 26, 2010, the entire content of which is incorporated herein by reference.

What is claimed is:

1. An inkjet printer comprising:

an inkjet head configured with nozzles and a nozzle header face, the nozzles which perform a flushing operation by discharging ink;

a pressurizer which performs a purge operation by pressurizing a route for ink supply to the inkjet head;

a head driver configured to drive the inkjet head to perform the flushing operation; and a controller configured to control the pressurizer to perform the purge operation for a prescribed time to render the nozzles covered with ink spilt out of the nozzles, and control the head driver to drive the inkjet head to perform the flushing operation in a maintenance service to the inkjet head in a state that the nozzles are covered by ink, wherein the flushing operation applies higher pressures to individual nozzles than the purge operation and discharges ink droplets, and wherein the flushing operation is executed after ink has been discharged to cover the nozzles during the purging operation.

2. The inkjet printer according to claim 1, wherein the controller is adapted in the maintenance service for a control of the head driver to exert on the nozzle higher pressures than in a normal print service.

3. The inkjet printer according to claim 1, wherein the controller is adapted in the maintenance service to retain use of the pressurizer to pressurize the route in course of the discharge operation.

4. The inkjet printer according to claim 1, wherein the controller is adapted in the maintenance service for use of the pressurizer to pressurize the route for a variable time depending on an environment temperature.

5. An inkjet head maintenance method for an inkjet head in an inkjet printer including the inkjet head being configured with nozzles and a nozzle header face, the nozzles which perform a flushing operation by discharging ink, a pressurizer which performs a purge operation by pressurizing a route for ink supply to the inkjet head, and a head driver configured to drive the inkjet head to perform the flushing operation, the inkjet head maintenance method comprising:

using the pressurizer to perform the purge operation for a prescribed time to render the nozzles covered with ink spilt out of the nozzles, using the head driver to drive the inkjet head to perform the flushing operation in a state that the nozzles are covered with ink, wherein the flushing operation applies higher pressures to individual nozzles than the purge operation and discharges ink droplets, and wherein the flushing operation is executed after ink has been discharged to cover the nozzles during the purging operation.

6. The inkjet maintenance method according to claim 5, comprising using the head driver to exert on the nozzle higher pressures than in a normal print service.

7. The inkjet head maintenance method according to claim 5, comprising retaining use of the pressurizer to pressurize the route in course of the discharge operation.

8. The inkjet head maintenance method according to claim 5, comprising using the pressurizer to pressurize the route for a variable time depending on an environment temperature.

* * * * *